US010987951B2

(12) United States Patent
Dim et al.

(10) Patent No.: US 10,987,951 B2
(45) Date of Patent: Apr. 27, 2021

(54) PRINT MEDIA EDGE REPAIR

(71) Applicant: HP SCITEX LTD., Netanya (IL)

(72) Inventors: Yuval Dim, Moshav Haniel (IL); Alex Veis, Kadima (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 16/732,961

(22) Filed: Jan. 2, 2020

(65) Prior Publication Data

US 2020/0139729 A1 May 7, 2020

Related U.S. Application Data

(63) Continuation of application No. 15/594,733, filed on May 15, 2017, now Pat. No. 10,538,112.

(30) Foreign Application Priority Data

May 27, 2016 (EP) ..... 16171835

(51) Int. Cl.
*B41J 11/00* (2006.01)
*B65H 23/34* (2006.01)

(52) U.S. Cl.
CPC ..... *B41J 11/0015* (2013.01); *B41J 11/0005* (2013.01); *B65H 23/34* (2013.01); *B65H 2301/5142* (2013.01); *B65H 2301/51232* (2013.01); *B65H 2301/51256* (2013.01);
(Continued)

(58) Field of Classification Search
CPC ... B41J 11/0015; B41J 11/006; B41J 11/0005; B65H 2301/51232; B65H 2301/51256; B65H 2301/5142; B65H 2301/515232; B65H 2301/515326; B65H 2701/1311;
(Continued)

(56) References Cited

U.S. PATENT DOCUMENTS

| | | | |
|---|---|---|---|
| 5,147,274 | A | 9/1992 | Mandel |
| 2003/0077101 | A1 | 4/2003 | Feiner |
| 2006/0236831 | A1 | 10/2006 | Walsh et al. |

(Continued)

FOREIGN PATENT DOCUMENTS

| | | |
|---|---|---|
| JP | 57173456 | 10/1982 |
| JP | 2008298925 | 12/2008 |

(Continued)

OTHER PUBLICATIONS

Xu, Renmei et al. "The effect of ink jet paper roughness on print gloss." Journal of imaging science and technology 49, No. 6 (Dec. 2005): 660-666.

*Primary Examiner* — Matthew Luu
*Assistant Examiner* — Kendrick X Liu
(74) *Attorney, Agent, or Firm* — HP Inc. Patent Department

(57) ABSTRACT

Examples described herein include a print media edge repair system that includes a first repair element disposed adjacent to a media handling path to repair a leading edge of a sheet of print media as the sheet of print media moves into a position relative to a printing system associated with the print media edge repair system. The print media repair system may also include a second repair element disposed opposite the first repair element across the media handling path to repair a trailing edge of the sheet of print media as the sheet of print media moves into the position relative to a printing system.

20 Claims, 10 Drawing Sheets

(52) U.S. Cl.
CPC ..... *B65H 2701/1311* (2013.01); *B65H 2701/1313* (2013.01); *G03G 2215/00708* (2013.01)

(58) Field of Classification Search
CPC .... B65H 2701/1313; B65H 2701/1315; G03G 2215/00708
See application file for complete search history.

(56) References Cited

U.S. PATENT DOCUMENTS

| | | | | |
|---|---|---|---|---|
| 2008/0290578 | A1 | 11/2008 | Ebihara et al. | |
| 2009/0256896 | A1 | 10/2009 | Scarlata | |
| 2012/0183338 | A1* | 7/2012 | Kanai | B65H 5/062 399/361 |
| 2012/0201590 | A1 | 8/2012 | Moore et al. | |
| 2013/0058697 | A1* | 3/2013 | Kunii | G03G 15/6558 400/611 |
| 2013/0164070 | A1* | 6/2013 | Cofler | B41J 15/16 400/621 |
| 2015/0264190 | A1 | 9/2015 | Arai | |

FOREIGN PATENT DOCUMENTS

| | | |
|---|---|---|
| JP | 2014185414 | 10/2014 |
| JP | 2014232215 | 12/2014 |
| WO | WO-2006122789 A1 | 11/2006 |

* cited by examiner

PRINT MEDIA EDGE REPAIR

CROSS REFERENCE TO RELATED APPLICATIONS

This is a continuation of U.S. application Ser. No. 15/594,733, filed May 15, 2017, U.S. Pat. No. 10,538,112, which claims priority from EP Application No. 16171835.8, filed May 27, 2016, which are hereby incorporated by reference in their entirety.

BACKGROUND

Printers and printing presses that print on inexpensive semi rigid and rigid print media are outfitted with media handling systems that help hold and manipulate the print media for the corresponding print engines. To avoid damage to the printhead in print engines that use non-contact printing technology, it is helpful to makes sure that flaws relating to the flatness of the print media are kept clear of the print head.

DETAILED DESCRIPTION

The present disclosure includes example implementations of devices, systems, and methods for repairing the edges, such as the leading and trailing edge of rigid and semi rigid print media for use in noncontact printing presses. Damaged edges of rigid and semi rigid print media that extend above and below a plane dispose of the proper distance for non-contact printing (e.g., stand proud of a print zone support member) can contact sensitive elements of the corresponding print engine. For example, in a corrugated cardboard printing press, the low-cost high-volume cardboard medium often has damaged edges which need to be kept clear of a print engine, such as the printhead of an inkjet type printer. If the damaged edge includes dents, rips, tears, warpage and other defects that cause it to not lay flat on a support member, the edge of the print media may run into, collide, or drag across the sensitive inkjet print circuitry and potentially cause damage, and consequently delays and lost productivity.

In example implementations described herein include an edge repair system that can apply various repair treatments to a sheet of print media as it is fed into the paper handling system of the printing press. In some implementations, the print media edge repair system can receive individual sheets of print media from a lateral stack of print media. In such implementations, the leading and trailing edges of the print media can be repaired in a single operation as the sheet of print media moves laterally into position to be fed into the print media handling system of the printing press. In various example implementations, the print media edge repair system can include two repair elements. The repair elements can include rotating cylinders or static ramps that apply either abrasive, cutting, crushing, or wetting type repair treatments to the edges of the print media. Such treatments trim off damage portions of the print media or otherwise reduce the height it stands from the place of the print zone support member to avoid collisions between the print media and the sensitive elements of the print engine. Specific examples will be described herein in reference to the accompanying figures to illustrate aspects of the present disclosure. The specific examples are intended to be illustrative only and are not intended to limit the scope of the present disclosure.

Figure 1:
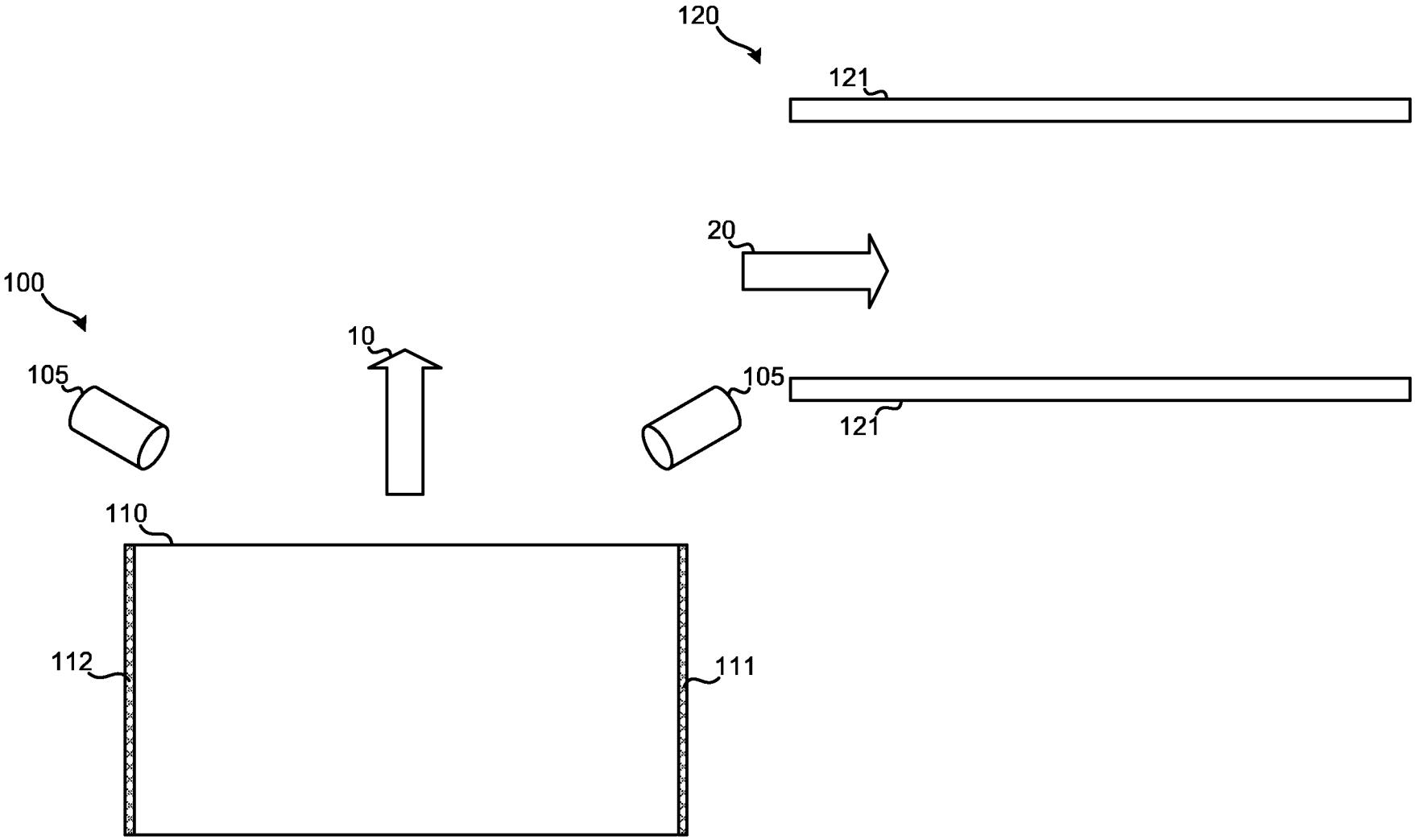
FIGS. 1-7 schematically depict the path of print media through an example print media edge repair system.

FIG. 1 depicts a schematic of the print media edge repair system 100 as implemented in various examples of the present disclosure. As shown, the print media edge repair system 100 can be disposed relative to a print media handling system 120 of an associated print engine or other printing device (not shown). In the particular example shown, the print media 110, such as corrugated cardboard, heavy card stock, particleboard, medium density fiber board (MDF), and the like can be loaded from a stack of print media disposed under the example print media 110 as illustrated. As a sheet of the print media 110 is selected from the top of the stack, it can be moved along the direction indicated by arrow 10 to repair the leading-edge 111 and the trailing edge 112 before being fed into the print media handling system 120 in the direction indicated by arrow 20.

To illustrate various aspects of the example implementation, FIGS. 1 through 7 schematically depict the processing of print media through the print media edge repair system 100 and the print media handling system 120. As described herein, the print media 110 can be loaded from a stack of print media. In such implementations, the stack of print media can be loaded onto an elevator or lift (not shown) adjacent to the print media edge repair system 100. The adjacent position may be lateral to the print media path through the print media handling system 120.

As sheets of print media 110 are pulled from the top of the stack, the lift can raise the next topmost sheet of print media 110 to be accessible by a loading device of the print media edge repair system 100 (not shown). In various example implementations, the stack of print media can be in the form of a stack of corrugated cardboard disposed on a pallet. As such, the elevator or lift of the print media edge repair system 100 can be arranged to accept the stack of corrugated cardboard and/or the pallet on which the corrugated cardboard is stacked.

As the loading device separates the topmost sheet of print media 110 from the underlying stack of print media, it can move the sheet along the direction indicated by arrow 10 by various corresponding media handling elements. Such media handling elements can include devices such as rollers, conveyor belts, suction cups, friction drives, lifters, vacuum handlers, and the like.

In some example implementations, as the sheet of print media 110 moves in the direction indicated by arrow 10, the so-called leading-edge 111 and the trailing edge 112 can be inspected by a damage sensor to determine if any damage exists. In particular, the damage sensor can determine whether the leading-edge 111 or the trailing edge 112 includes any physical defects such as tears, dents, delaminating liners, ripples, water damage, discoloration, dirt, warping, and the like. Accordingly, in corresponding implementations, in the event that damage is detected on the leading-edge 111 or the trailing edge 112, various repair treatments can be applied in an attempt to eliminate or reduce the degree of damage that could in turn damage elements of the associated print engine.

In some implementations, the damage sensor can include various noncontact based sensors or imaging devices such as digital cameras, machine visions sensors, infrared sensors, light sensors, etc. that scan for visual indications of damage to the leading-edge 111 or the trailing edge 112. In other implementations, the damage sensor can include any number of contacts sensors. For example, the contact sensors can include any type of pressure sensor, trip bar, switch, etc. In any such implementations, inspection of the leading-edge 111 or the trailing edge 112 can occur before during or after the topmost sheet of print media 110 is removed from the stack of print media. As described herein, when inspection of the leading-edge 111 or the trailing edge 112 reveals damage, the print media edge repair system 100 can selectively apply repair treatments to one or both of the leading-edge 111 and/or trailing edge 112. In other example implementations, the print media edge repair system 100 does not include a damage sensor or the included damage sensor can be disabled such that the print media edge repair system 100 can apply a repair treatments to any and all sheets of print media 110 in the stack of print media.

In implementations in which the print media edge repair system 100 selectively or universally applies a repair treatment to sheets of print media 110, the progression of the sheet of print media 110 through the print media edge repair system 100 and/or the print media handling system 120 is depicted in FIGS. 1 through 7.

In FIG. 1, the sheet of printing media 110 is depicted as being on top of a stack of print media (not shown). The topmost sheet of print media 110 can then be separated from the stack and moved along in the direction indicated by arrow 10. As the selected sheet of print media 110 moves along in the direction indicated by arrow 10, a repair treatment can be applied to the edges 111 and/or 112.

Figure 2:
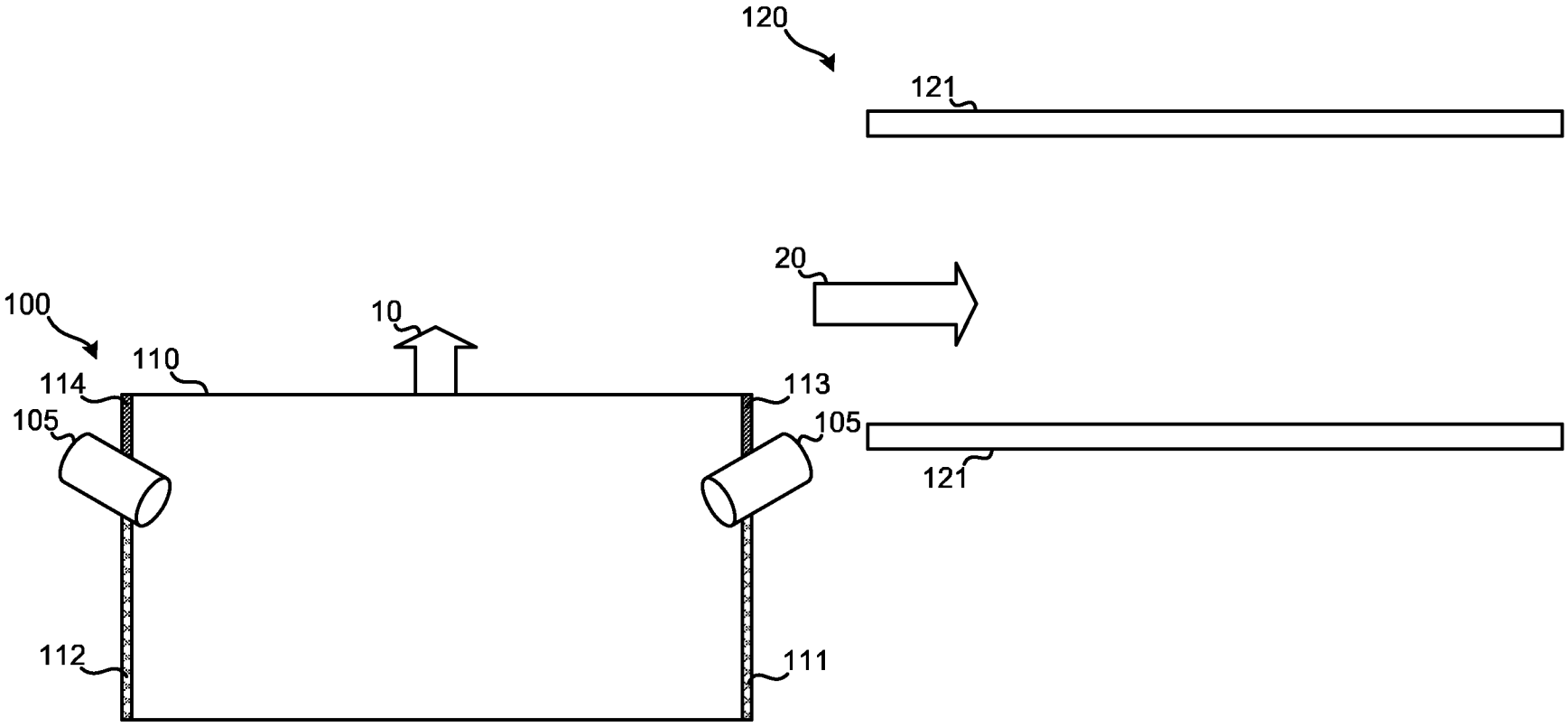

For the purposes of this disclosure, the leading edge 111 refers to the edge of the sheet of print media 110 before application of a repair treatment. Similarly, the trailing edge 112 can refer to the edge of the sheet to print media 110 before application of a repair treatment. Accordingly, the terms leading-edge 111 is also referred to herein as untreated or unrepaired leading-edge 111, and the terms trailing edge 112 is also referred to herein as untreated or unrepaired trailing edge 112. As such, as indicated in FIG. 2, portions of the leading-edge 111 and/or trailing edge 112 to which the print media edge repair system 100 has applied a corresponding repair treatment are referred to herein as treated or repaired leading-edge 113 and/or treated or repaired trailing edge 114.

In the example implementation of the print media edge repair system 100 depicted in FIGS. 1 through 7, the repair treatment can be applied by repair elements 105. In the particular example illustrated, the repair elements 105 can apply corresponding repair treatments to the corresponding leading-edge 111 and/or trailing edge 112. For example, the repair elements 105 can include various types of rollers, blades, sponges, membranes, scrapers, etc. As such, the repair elements 105 can include features to apply a corresponding repair treatments that include treatments such as, abrasive treatments, cutting treatments, wetting treatments, crushing treatments, steam treatments, and the like.

In one example, the repair elements 105 can include rollers coated in an abrasive, such as sand, ceramic, diamond, textured metal, and the like. In such implementations, the abrasive can be adhered to a substrate support attached to the repair element 105, such as a band of sandpaper that can be disposed around a roller. Accordingly, in such implementations, application of the repair elements 105 can include repair treatments that even out, knockdown, realign, or otherwise alter or remove the damage to a particular leading-edge 111 or trailing edge 112. For example, the abrasive or cutting effects of such repair treatments can remove or correct any areas of the damaged leading edge 111 or trailing edge 112 that might interfere with the other elements of the paper handling system 120 or an associated print engine.

Other example repair elements 105 can include sponges, felts, or other porous materials that can hold and/or apply a liquid wetting agent. In some implementations, the liquid wetting agent can include any liquid. For example, the wetting agent can include water, alcohol, oil, adhesive, or any other solvent and/or fixative. In such implementations, the repair elements 105 can include a roller that includes a porous material to apply the corresponding wetting agent to the leading edge 111 or trailing edge 112. The application of a wetting agent in such implementations can reduce or eliminate any areas of damage on the leading-edge 111 or trailing edge 112 that might interfere with other elements of the paper handling system 120 or an associated print engine.

Any type of repair elements 105 can include auxiliary devices or systems that supply or maintain the various capabilities of repair elements 105. For example, repair elements 105 can include or be coupled to a system that supplies or maintains the corresponding abrasive, cutting, crushing, or wetting qualities. For example, in one implementation, the repair elements 105 can include a system for automatically or manually replacing the blades or sandpaper band disposed around the roller. In another implementation, the repair elements 105 can include a system or be connected to corresponding pumps and ducts that supply the roller and the porous material disposed thereon with the corresponding wetting material.

Figure 3:
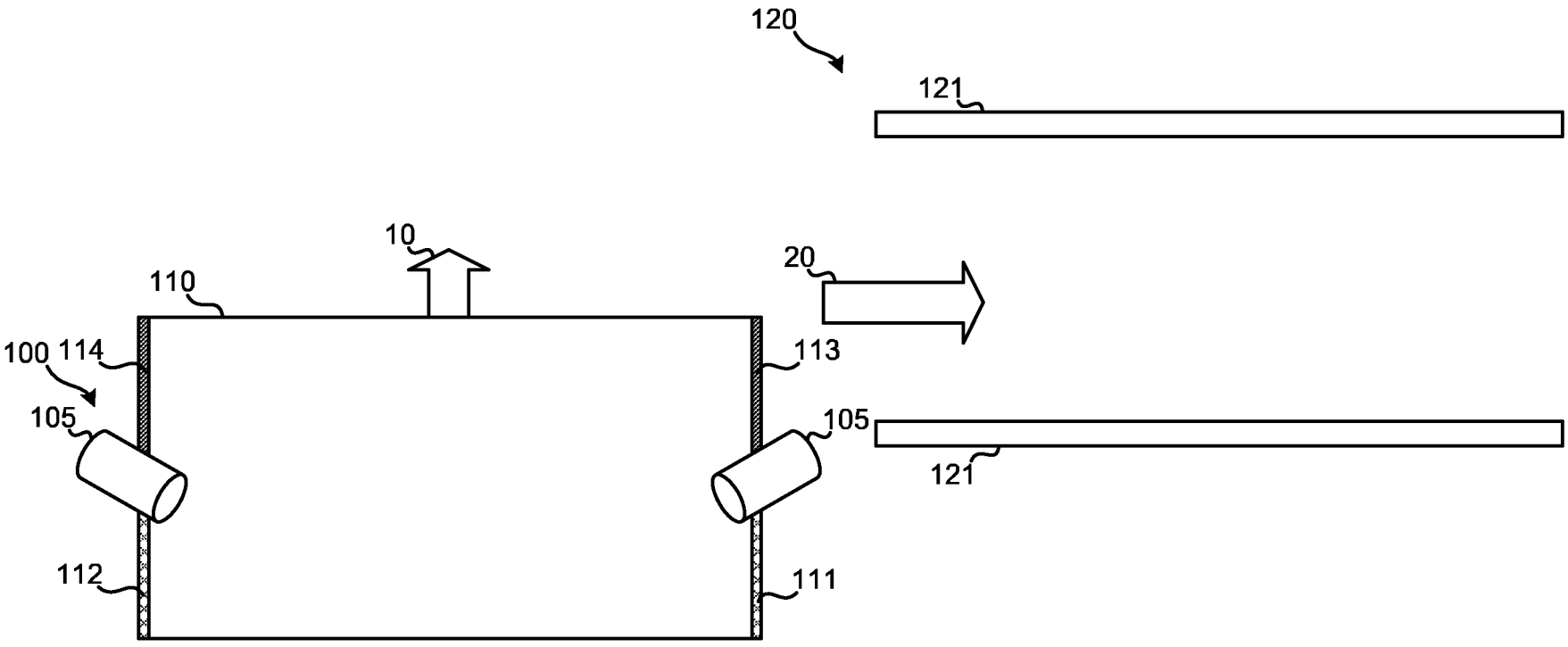
Figure 4:
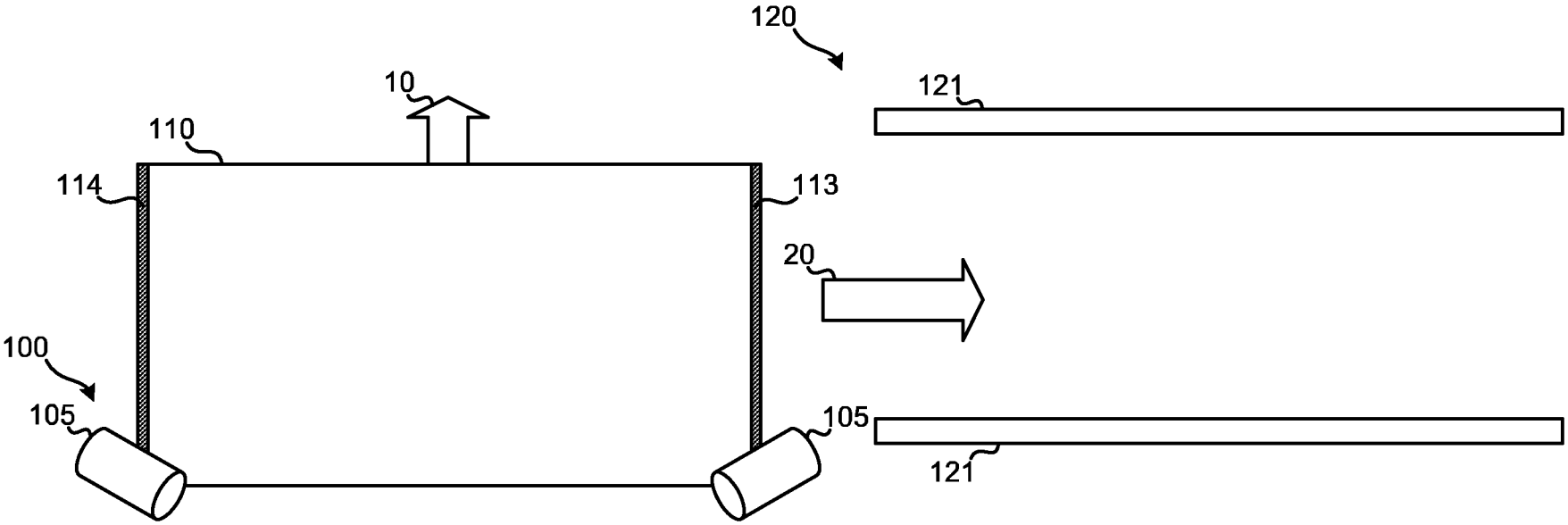

Turning back to the figures, as the sheet of print media 110 progresses in the direction indicated by arrow 10 in FIGS. 2 through 4, repair elements 105 can continuously, selectively, and/or simultaneously apply a repair treatment to the leading-edge 111 and the trailing edge 112 to generate a treated or repaired leading-edge 113 and trailing edge 114. Accordingly, as print media edge repair system 100 moves the sheet of print media 110 past the repair elements 105, the repair elements 105 can apply a repair treatment to the leading-edge 111 and the trailing edge 112 to generate the corresponding repaired leading-edge 113 and the repaired trailing edge 114.

In some implementations, the repair treatments applied by the repair elements 105 can be the same for the leading-edge 111 and the trailing edge 112. However, in other implementations, the repair treatments applied by the repair elements 105 can be different for the leading-edge 111 and trailing edge 112. Accordingly, in some implementations, the repair elements 105 can apply any combination of abrasive or wetting type repair treatments. For example, repair elements 105 can include multiple types of rollers that have either abrasive elements or wetting elements.

Figure 5:
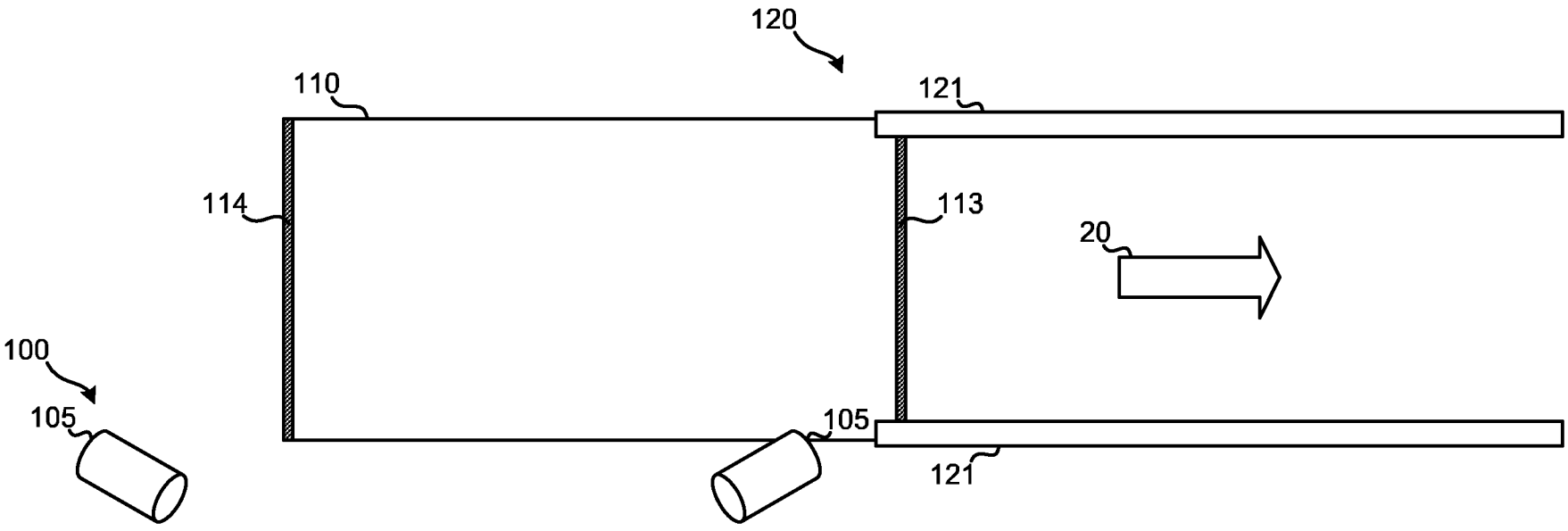

FIG. 5 depicts the scenario in which print media edge repair system 100 has positioned the sheet of print media 110 with repaired leading-edge 113 and repaired trailing edge 114 for insertion into the print media handling system 120. As shown, the position of the sheet of the print media 110 is such that the side edges orthogonal and/or adjacent to the repaired leading-edge 113 can be inserted into the guide elements 121 of the print media handling system 120. In some implementations, the guide elements 121 of the print media handling system 120 can include rails, slots, hold downs, etc. that can guide, hold down, and/or align the side edges of the sheet of print media 110 as it moves through the print media handling system 120 in the direction indicated by arrow 20. In some implementations, the guide elements 121 may also include elements for moving the sheet of print media 110 through the print media handling system 120. For example, the guide elements 121 can include belts, rollers, clips, etc. that can engage the sheet of print media 110 to move it forward along the print media path indicated by arrow 20.

In other implementations, all four edges of a sheet of print media 110 can be repaired or treated. In such implementations, the guide elements 121 can be omitted and an additional print media edge repair system can be disposed between the print media edge repair system 100 and the print media handling system 120 to repair the so-called side edges of the sheet of print media 110.

Figure 6:
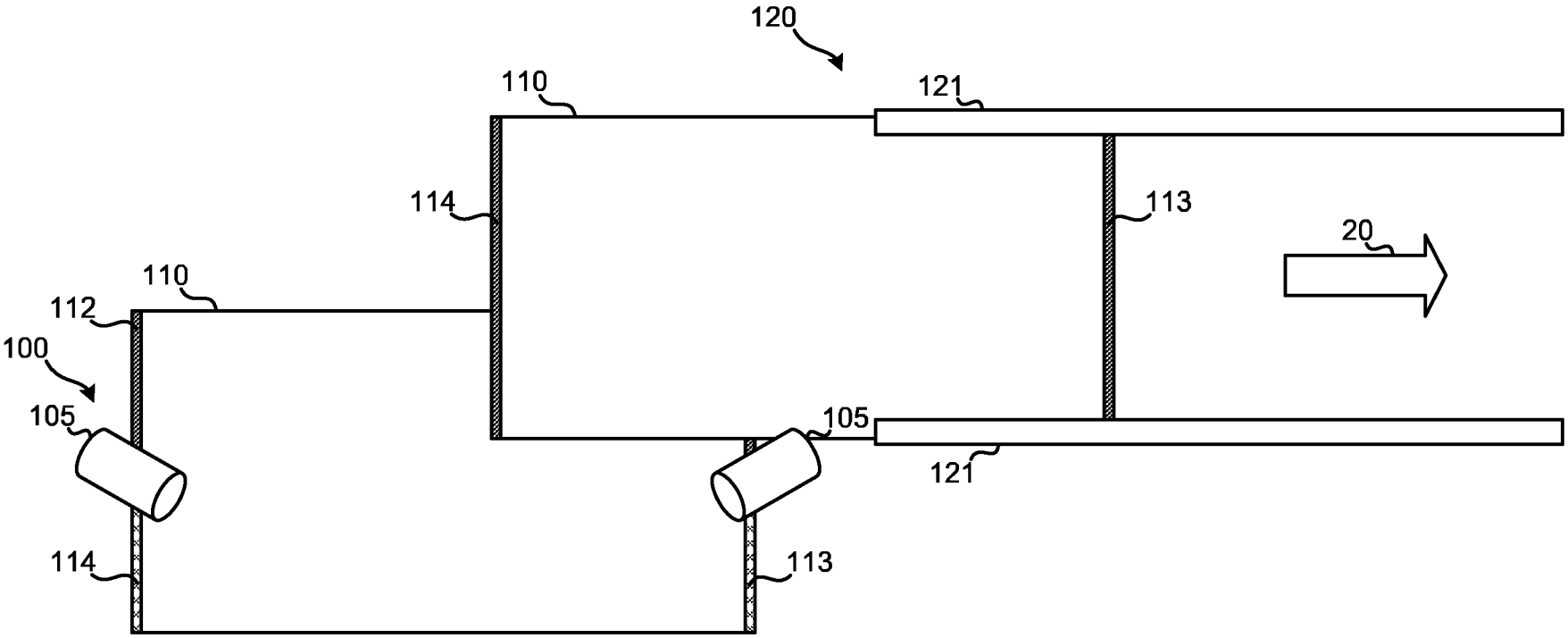
Figure 7:
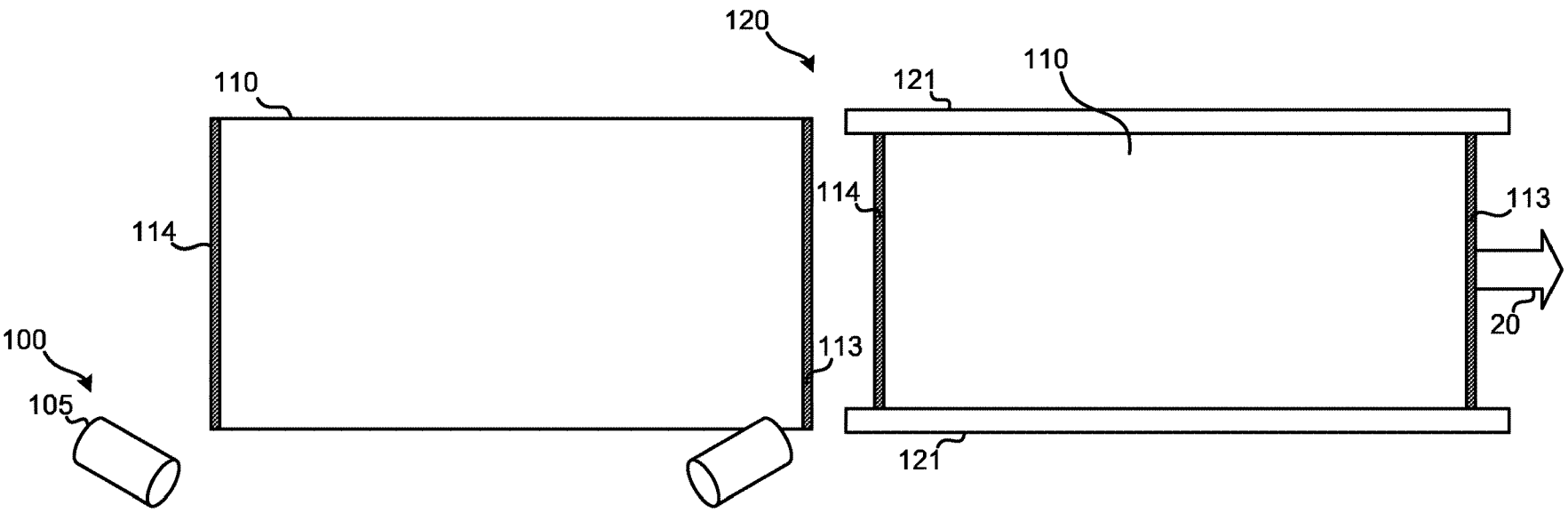

Turning now to FIG. 6 as a first sheet of print media 110 is inserted into the print media handling system 120, a subsequent sheet of print media 110 can be processed by the print media edge repair system 100 as described herein. As such, the print media handling system 120 can be supplied with a constant supply of sheets of print media 110 having treated or otherwise repaired leading edges 113 and/or trailing edges 114, as depicted in FIG. 7.

In the example implementation depicted in FIGS. 1 through 7, the paths traversed by the sheets of print media 110 through the print media edge repair system 100 and the print media handling system 120 are orthogonal in a particular direction. In particular, the directions indicated by arrows 10 and 20 are approximately right angles to one another. The directions indicated by arrow 10 thus defines a print media path through the print media edge repair system 100 and the direction indicated by arrow 20 thus defines a print media path through the print media handling system 120 and/or the associated print engine.

As illustrated, the print media paths through the print media handling system 120 and the print media edge repair system 100 can be at angles relative to one another. Configurations of print media edge repair systems 100 and print media handling systems 120 like those depicted in FIGS. 1 through 7 can allow for in-line repair of the edges of the sheets of print media 110. The differences in print media path orientations between the print media edge repair system 100 and the print media handling system 120 are what lead to the use of the terms "leading-edge" and "trailing edge" relative to the path through which that sheet of print media 110 is fed through the print media handling system 120 and/or the associated print engine.

In other implementations, it is possible for the print media edge repair system 100 to be disposed on the other side of the print media handling system 120 such that the direction of travel of a processed or otherwise repaired sheet of print media 110 would be in a direction opposite arrow 10. In particular, the print media edge repair system 100 may also be movable to select and repair sheets of print media 110 from stacks of print media disposed on either side of the print media handling system 120 to increase the available supply of print media while reducing the amount of manual labor required to keep the print media handling system 120 and/or an associated printer, a printing press, or print engine running at increased throughput capacity.

Figure 8:
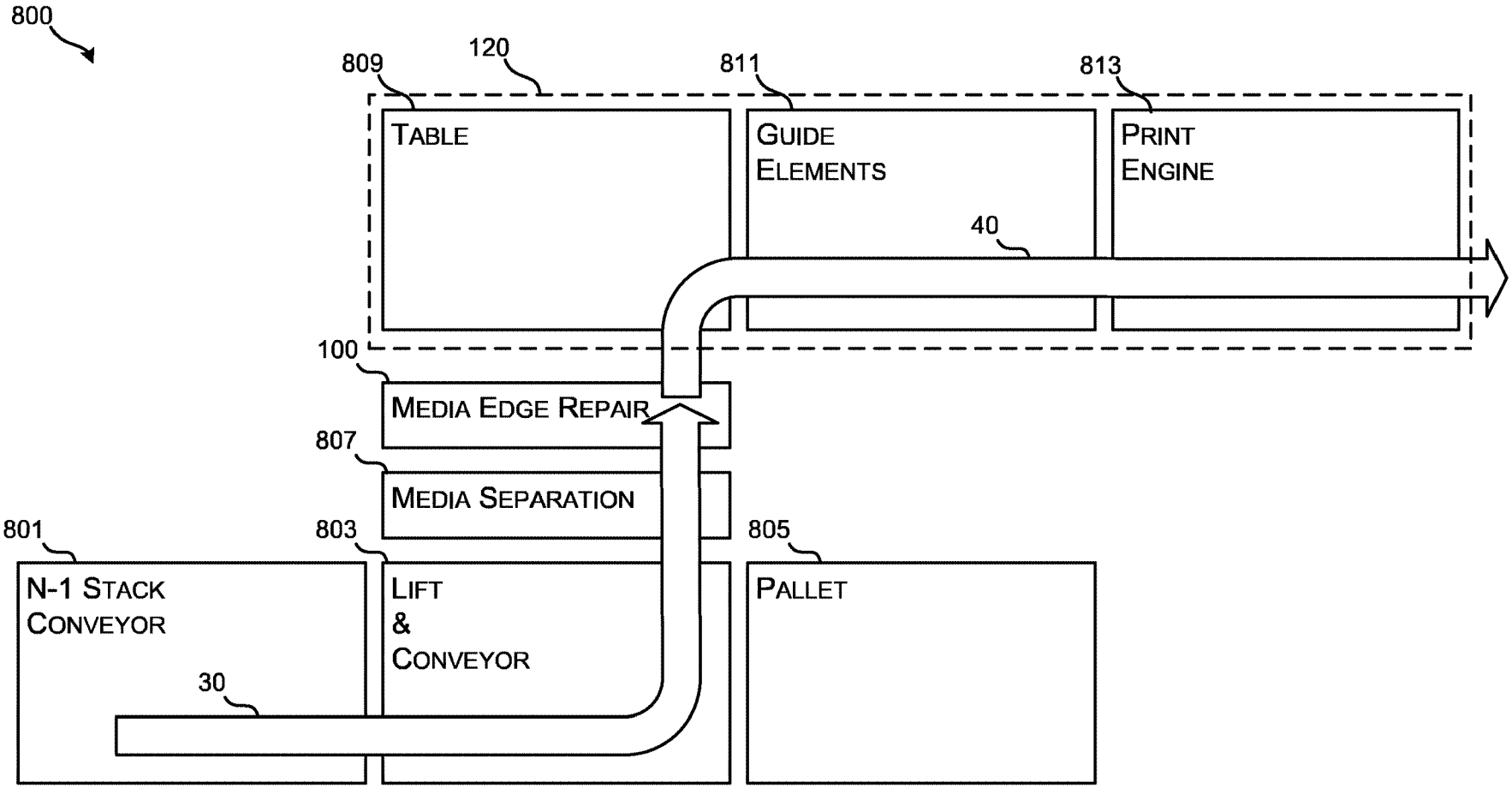
FIG. 8 depicts a schematic representation of an example print media edge repair system.

FIG. 8 depicts an example printing system 800 according to various implementations of the present disclosure. As shown, the example printing system 800 can include various subcomponents, devices, or systems. While a particular combination and separation of the functionality described in reference to FIG. 8 is presented as an example, it is possible for other example implementations to include more or fewer subcomponents, devices, or systems without departing from the spirit or scope of the present disclosure.

In the particular example shown in FIG. 8, the printing system 800 can include various components for feeding stacks of print media into the system. For example, the printing system 800 can include an N−1 stack conveyor 801 for feeding print media in stacks to the lift and conveyor 803. In some implementations, the N−1 stack conveyor 801 can include elements for transporting palletized stacks of print media to the lift and conveyor 803.

Lift and conveyor 803 can accept a pallet of print media and incrementally lift the topmost sheet of print media 110 to meet with a level compatible with the media separation system 807. The media separation system 807 can include various grabbers, suction cups, vacuum systems, and other elements for removing a single sheet of print media 110 from the stack of print media provided by the lift and conveyor 803. Once the media separation system 807 has removed the last sheet of print media 110 from a stack of print material, the lift and conveyor 803 can eject empty pallets 805 in a position opposite the direction from which the N−1 stack conveyor 801 provides the palletized stacks of print media.

As the media separation system 807 selects single sheets of print media 110 from the stack of print media, it can move the individual sheets of print media 110 through the print media edge repair system 100 as discussed above. As such, the path indicated by arrow 30 can correspond to the print media path through the supply and print media edge repair system 100. As previously described, once the print media edge repair system 100 has processed a particular sheet of print media 110, it can be provided to various elements of a print media handling system 120.

In the particular example shown the print media handling system 120 can include various subcomponents, devices and elements for moving, processing, and printing on the print media, such as the loading table 809, guide elements 811, and print engine 813. In some implementations, the loading table 809 can include various mechanisms for holding a sheet of print media 110 to the surface in a substantially flat configuration. Loading table 809 can also include elements for moving the table 809 and/or the sheet of print media 110 to insert the repaired leading-edge 113 into guide elements 811.

In some implementations, the guide element 811 can include rails for holding down the side edges of the sheets of print media 110, orifices for providing vacuum to hold the sheets of print media 110 flat, and/or elements for moving the sheets of print media 110 through the print engine. The print engine 813 can include various elements, such as inkjets, liquid photographic drums, and the like for selectively applying printing material to the surface of the sheets of print media 110 to generate a printed image. Once the printed images are generated on the surface of the sheets of print media 110, the printing system 800 can eject or output the printed sheets of print media 110. In some implementations, the printed sheets of print media wanted 10 can be stacked on another pallet, such as pallet 805.

Figure 9:
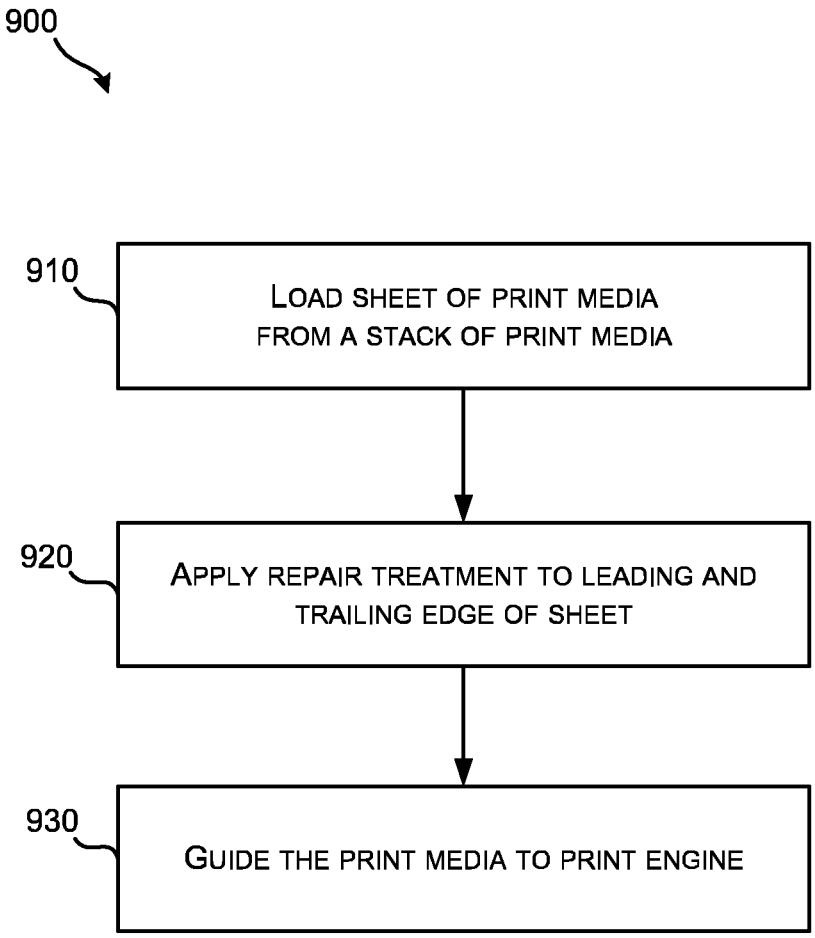
FIG. 9 is flowchart of an example method for repairing print media edges.

FIG. 9 is a flowchart of an example method for repairing edges of print media according to various implementations the present disclosure. The method 900 can begin at box 910 in which a system, such as the printing system 800 or the print media edge repair system 100 loads a sheet of print media 110 from a stack of print media. The system can then apply a repair treatment to the leading and trailing edges of the print media, at box 920.

Application of a particular repair treatment can be provided by a corresponding repair elements 105 to either abrade or wet the region immediately abutting the leading-edge and/or the trailing edge of the sheet of print media 110. For example, the repair treatment can be applied to the first few millimeters or the first a few centimeters of the print material to compensate for any damage of the leading-edge or the trailing edge that may interfere or damage other components of the system. As such, once the repaired or treated sheet of print media 110 is passed through the print media edge repair system 100, it can then be guided to the print engine, at box 930. In some implementations, when the system guides the sheets of print media 110 to the print engine 813, the direction that the sheet of print media 110 travels through the system can change.

The designation of the edges of the sheet of print media 110 as the leading-edge and the trailing edge can be in reference to the direction of travel that a particular sheet of print media 110 travels through an associated print media handling system, such as print media handling system 120. As such, the leading-edge of a particular sheet of print media 110 can refer to the edge of the print media that passes through a particular print media path first. The trailing edge of a particular sheet of print media 110 can refer to the edge of the print media that passes through a particular print media path last.

Figure 10:
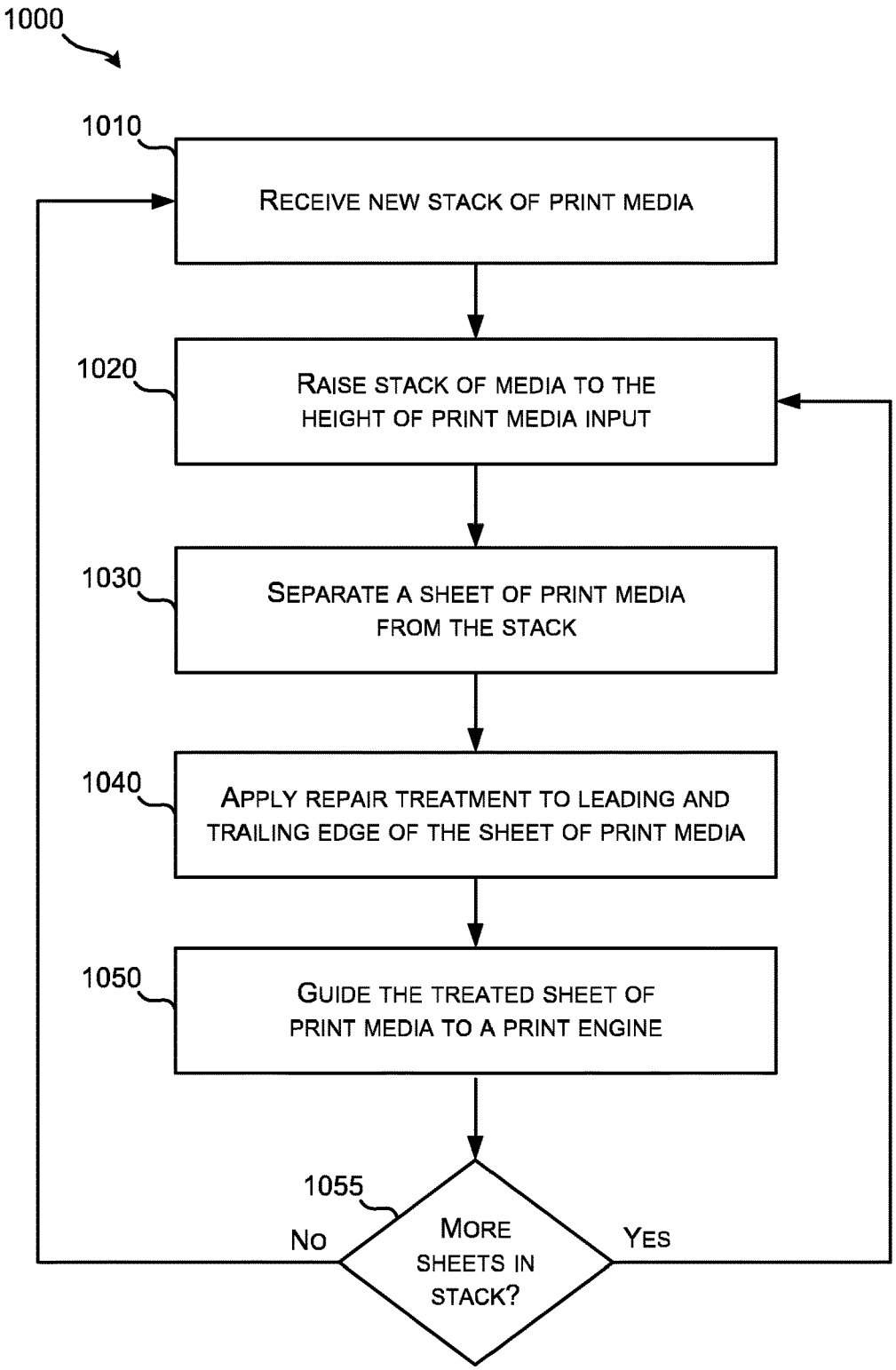
FIG. 10 depicts an example of another example method for repairing print media edges.

FIG. 10 depicts another example method 1000 of repairing edges of print media. In the example implementation shown in FIG. 10, the method 1000 can begin at box 1010 in which a printing system can receive a new stack of print media. As described herein, the stack of print media sheets can be in the form of a palletized stack of corrugated cardboard. With the stack of print media in place, the printing system can raise the stack of print media to the height of a print media input table to present the topmost sheet of print media to the system, at box 1020.

At box 1030, the printing system can separate a single sheet of print media from the stack of print media. In some implementations, the process or mechanism by which the system separates a single sheet of print media from the stack can also include inspecting the edges of the sheet of print media 110 to determine whether there is damage. In some implementations, at box 1040, the system can selectively apply a repair treatment to the leading and trailing edges of the sheet of print media 110 in response to the detection of damage thereon. In other implementations, at box 1040, the system can universally apply a repair treatment to the leading and trailing edges of the sheet of print media 110.

At box 1050, the printing system can guide the repaired print media sheet to a print engine. Guiding the treated print media sheets to a print engine can include inserting the sheet of print media 110 having repaired or treated leading and trailing edges into a set of guide rails that hold down or otherwise control potentially damaged side edges of the sheet of print media 110. At determination 1055, the system can determine whether or not there are more sheets of print media in the stack. If there are no more sheets of print media in the stack, then the system can receive a new stack of print media sheets. However, if the system determines that there are more sheets in the stack of print media, then the operations described in reference to boxes 1020 through 1055 can be repeated until that particular stack of print media is depleted.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A system comprising:

a first repair element disposed relative to a media handling path to repair a first edge of a sheet of print media as the sheet of print media moves along a first direction into a position relative to a printing system;

a second repair element disposed opposite the first repair element across the media handling path to repair a second edge of the sheet of print media as the sheet of print media moves along the first direction into the position relative to the printing system, wherein the first direction is parallel to each of the first edge and the second edge;

a guide element to guide, along a second direction, the sheet of print media after the repairs by the first repair element and the second repair element, toward a print engine to apply a printing material to a surface of the sheet of print media, wherein the second direction is different from and angled with respect to the first direction; and a damage sensor to detect damage to the first edge or the second edge, wherein the system is to:

selectively use the first repair element to repair the first edge in response to the damage sensor detecting the damage to the first edge, and selectively use the second repair element to repair the second edge in response to the damage sensor detecting the damage to the second edge.

2. The system of claim 1, wherein the second direction is orthogonal to each of the first edge and the second edge.

3. The system of claim 2, wherein each of the first direction and the second direction is in a plane of the surface of the sheet of print media.

4. The system of claim 1, wherein the second direction is orthogonal to the first direction.

5. The system of claim 4, wherein each of the first direction and the second direction is in a plane of the surface of the sheet of print media.

6. The system of claim 1, further comprising another guide element to guide the sheet of print media along the second direction after the repairs by the first repair element and the second repair element.

7. The system of claim 1, wherein the first repair element and the second repair element are to simultaneously repair the corresponding first edge and the second edge in a single operation.

8. The system of claim 1, wherein the first repair element and the second repair element are to simultaneously repair the corresponding first edge and the second edge of the sheet of print media as the sheet of print media moves into the position.

9. The system of claim 1, wherein the first repair element or the second repair element comprises a roller.

10. The system of claim 9, wherein the roller is coated with an abrasive material to repair the corresponding first edge or second edge.

11. The system of claim 1, wherein the first repair element or the second repair element comprises a blade to repair the corresponding first edge or second edge.

12. The system of claim 1, wherein the first repair element or the second repair element comprises a porous material to apply a liquid wetting agent to repair the corresponding first edge or second edge.

13. The system of claim 1, wherein the damage sensor comprises an imaging device.

14. The system of claim 1, wherein the damage sensor comprises a contact sensor.

15. The system of claim 1, wherein the first repair element and the second repair element comprise corresponding abrasive elements.

16. The system of claim 1, wherein the first repair element and the second repair element comprise corresponding wetting elements.

17. A system comprising:

a first repair element disposed relative to a media handling path to repair a first edge of a sheet of print media as the sheet of print media moves along a first direction into a position relative to a printing system;

a second repair element disposed opposite the first repair element across the media handling path to repair a second edge of the sheet of print media as the sheet of print media moves along the first direction into the position relative to the printing system, wherein the first direction is parallel to each of the first edge and the second edge, wherein the first repair element and the second repair element comprise corresponding wetting elements; and a guide element to guide, along a second direction, the sheet of print media after the repairs by the first repair element and the second repair element, toward a print engine to apply a printing material to a surface of the sheet of print media, wherein the second direction is different from and angled with respect to the first direction.

18. The system of claim 17, wherein the second direction is orthogonal to each of the first edge and the second edge.

19. A method comprising:

repairing, using a first repair element disposed relative to a media handling path, a first edge of a sheet of print media as the sheet of print media moves along a first direction into a position relative to a printing system;

repairing, using a second repair element disposed opposite the first repair element across the media handling path, a second edge of the sheet of print media as the sheet of print media moves along the first direction into the position relative to the printing system, wherein the first direction is parallel to each of the first edge and the second edge; and guiding, by a guide element, the sheet of print media along a second direction after the repairs by the first repair element and the second repair element, toward a print engine to apply a printing material to a surface of the sheet of print media, wherein the second direction is different from and angled with respect to the first direction, wherein the second direction is orthogonal to each of the first edge and the second edge.

20. The method of claim 19, wherein each of the first direction and the second direction is in a plane of the surface of the sheet of print media.

* * * * *